US008869720B2

(12) United States Patent
Ingram, III et al.

(10) Patent No.: US 8,869,720 B2
(45) Date of Patent: Oct. 28, 2014

(54) PORTABLE CREELS WITH INSERTABLE YARN TRAYS AND IMPROVED HEADERS AND YARN HANDLING METHODS

(75) Inventors: William Oscar Ingram, III, Valley, AL (US); William N. Jones, West Point, GA (US); Horace Eddie Bradley, Jr., Shanghai (CN)

(73) Assignee: Interface, Inc., Atlanta, GA (US)

( * ) Notice: Subject to any disclaimer, the term of this patent is extended or adjusted under 35 U.S.C. 154(b) by 616 days.

(21) Appl. No.: 13/164,321

(22) Filed: Jun. 20, 2011

(65) Prior Publication Data

US 2011/0308438 A1 Dec. 22, 2011

Related U.S. Application Data

(60) Provisional application No. 61/356,246, filed on Jun. 18, 2010.

(51) Int. Cl.

| | |
|---|---|
| ***D05C 15/00*** | (2006.01) |
| ***B65H 57/12*** | (2006.01) |
| ***D05C 15/18*** | (2006.01) |
| ***B65H 49/16*** | (2006.01) |
| ***B65H 67/02*** | (2006.01) |
| ***D02H 1/00*** | (2006.01) |
| ***B65H 57/16*** | (2006.01) |
| ***D03D 39/06*** | (2006.01) |

(52) U.S. Cl.

CPC ..... *D05C 15/18* (2013.01); *B65H 2701/31* (2013.01); *B65H 57/12* (2013.01); *B65H 49/16* (2013.01); *B65H 67/02* (2013.01); *D02H 1/00* (2013.01); *B65H 57/16* (2013.01); *D03D 39/06* (2013.01)

USPC ..... 112/80.01; 112/80.07

(58) Field of Classification Search

CPC ..... B65H 49/16; B65H 57/003; B65H 57/12; B65H 57/16; B65H 2701/31; D02H 1/00; D05C 15/18; D05C 15/34

USPC ..... 112/80.01, 80.07

See application file for complete search history.

(56) References Cited

U.S. PATENT DOCUMENTS

| | | | |
|---|---|---|---|
| 3,102,702 | A | 9/1963 | Miller |
| 4,471,917 | A | 9/1984 | Whisnant |

(Continued)

FOREIGN PATENT DOCUMENTS

| | | |
|---|---|---|
| CN | 103069066 | 4/2013 |
| DE | 7413531 | 7/1975 |

(Continued)

OTHER PUBLICATIONS

PCT/US2011/041088, Invitation to Pay Additional Fees and partial Search Report, 8 pages.

(Continued)

*Primary Examiner* — Nathan Durham

(74) *Attorney, Agent, or Firm* — Kilpatrick Townsend & Stockton LLP

(57) ABSTRACT

Creels having frames configured to receive one or more trays of yarn packages. The trays of yarn packages are removable from the frame and can be loaded with packages of yarn when not inserted into the frame. Separately loading trays with yarns can simplify and provide other benefits with respect to the process of loading a creel with yarn packages. Also disclosed is an assembly that is positioned with respect to a detachable header and a stationary header on a creel and that comprises an air flow unit that causes yarns to move through to an alignment mechanism that aligns the yarns for attachment to yarns already feeding into a tufting machine.

15 Claims, 16 Drawing Sheets

(56) References Cited

U.S. PATENT DOCUMENTS

| | | | | |
|---|---|---|---|---|
| 4,498,644 | A | 2/1985 | Kupper et al. | |
| 4,515,328 | A | 5/1985 | Payne, Jr. | |
| 4,572,458 | A | 2/1986 | Bluhm et al. | |
| 4,836,468 | A | 6/1989 | Singer | |
| 5,024,393 | A | 6/1991 | Gutschmit | |
| 5,323,982 | A | 6/1994 | Ligon et al. | |
| 5,531,392 | A | 7/1996 | Weiner | |
| 5,588,383 | A | 12/1996 | Davis et al. | |
| 5,624,082 | A | 4/1997 | Ligon | |
| 6,634,585 | B1 | 10/2003 | Ingram, III | |
| 7,004,415 | B2 | 2/2006 | Ingram, III | |
| 7,316,366 | B2 | 1/2008 | Ingram, III | |
| 7,506,831 | B1 | 3/2009 | Weiner | |
| 7,806,360 | B2 | 10/2010 | Chadwick | |
| 2006/0049297 | A1 | 3/2006 | Ingram | |
| 2007/0084960 | A1 | 4/2007 | Heaney et al. | |
| 2008/0173643 | A1 * | 7/2008 | Wadsworth et al. | 220/8 |
| 2011/0041088 | A1 | 2/2011 | Mason et al. | |
| 2013/0228644 | A1 | 9/2013 | Willis et al. | |

FOREIGN PATENT DOCUMENTS

| | | |
|---|---|---|
| DE | 3429153 | 2/1985 |
| UY | 33460 | 1/2012 |
| WO | 0027532 | 5/2000 |
| WO | 2011160121 | 12/2011 |
| WO | PCT/US2011/041088 | 12/2011 |
| WO | 2013134191 | 9/2013 |

OTHER PUBLICATIONS

PCT/US2011/041088, Notification of Transmittal of the International Search Report and Written Opinion, Dec. 23, 2011, 16 pages.
PCT/US2011/041088 , "International Preliminary Report on Patentability", Jan. 3, 2013, 19 pages.
PCTUS2013028995 , "International Search Report and Written Opinion Received", May 28, 2013, 10 pages.

* cited by examiner

PORTABLE CREELS WITH INSERTABLE YARN TRAYS AND IMPROVED HEADERS AND YARN HANDLING METHODS

RELATED APPLICATIONS

This application claims the benefit of U.S. Provisional Application Ser. No. 61/356,246 filed Jun. 18, 2010 titled "Creel Frames with Insertable Yarn Trays and Improved Headers," the content of which is hereby incorporated by reference.

FIELD OF THE INVENTION

The field of this invention is systems and methods for manufacturing carpet, carpet tiles, and other products, using tufting machines, and more specifically, systems and methods for handling yarn supplied to tufting machines.

BACKGROUND

Tufting machines are used in the manufacture of various products. A tufting machine typically receives multiple yarns that are used by the tufting machine to create loops or tufts in a backing material. In many tufting machines, each of multiple adjacent needles uses a thread of yarn to tuft a row of tufts. Because many such needles may require different yarns simultaneously, many tufting machines require that multiple yarns be fed into or otherwise received by the tufting machine at relatively the same time.

Yarn is typically supplied directly to the tufting machine in one of two general ways. First, yarn may be supplied from a "creel," which is a rack or series of racks holding large bobbins or cones from which yarn spools into the tufting machine. Yarn wound onto a cardboard or plastic cylindrical core or "bobbin" or a conical "cone" is referred to as a "yarn package." Alternatively, yarn can be fed first onto a "beam," a large horizontal mandrel onto which multiple strands of yarns are wound in advance. Such yarns can be supplied to the beam from a creel. The beam is then mounted adjacent to the tufting machine, and the yarn strands are unwound simultaneously from the beam into the tufting machine. To position the yarn strands on a beam, bobbins or other yarn packages must generally be positioned on creels to "feed" the beam, much as the yarn packages would be positioned to feed a tufting machine directly.

Initially, creels were arrays or systems of stationary yarn package holders spaced out adjacent to tufting machines. Such creels occupied large amounts of manufacturing facility floor space, and the tufting machine supplied with yarn from a particular creel had to be out of service while yarn was being loaded into, removed from or otherwise handled in the creel.

Generally, preparing and using creels to feed tufting machines and beams requires significant amounts of labor. First, a significant amount of labor is generally required to prepare each of the bobbins or other packages that are used in a creel. This is because, in many cases, yarn is provided by a yarn manufacturer in a manner that is not appropriate for use on a creel. For example, a carpet manufacturer's creels may be configured to use relatively small bobbins. Thus, in this scenario, the carpet manufacturer may take yarn from the typically large bobbins or packages provided by a yarn manufacturer and use that yarn to create smaller bobbins or packages that are usable on the carpet manufacturer's creels.

In addition, to prepare a creel for feeding a tufting machine or beam, significant time is often required to load properly the bobbins or packages onto the creel. Generally, each bobbin or package used on a creel must be individually positioned and its thread correctly positioned for use. For example, one technique for loading a creel may involve loading each bobbin or package into a particular yarn package holder on the creel. This loading can be complicated depending on the number of different colors and/or types of yarn that are used in the particular tufted product. Generally, a person loading such creels will have to spend time ensuring that bobbins or other packages are placed on appropriate holders so that the yarn on each holder will feed through the correct tube that leads to the correct header location.

In addition, once a bobbin is properly positioned on a holder, its yarn must generally be manually positioned or otherwise prepared for connection into the tufting machine. For example, for each bobbin or package, the loading process may require manually inserting the yarn end into a tube and using an air gun to blow the yarn through the tube until the yarn end projects from the other end of the tube, for example, through one or more headers. Once the yarn ends have been so positioned, they may then be attached to existing yarns already feeding into a tufting machine or onto a beam. In some processes, all of the yarn ends are positioned on a creel so that they extend through individual holes in a detachable header.

A detachable header can be used to facilitate connection of yarns into a tufting machine in a manner similar to or different from conventional techniques. For example, once yarns from the yarn holders on the creel are run through such a detachable header, the detachable header can be removed from the creel (along with the yarns that are running through it) and positioned on or adjacent to a tufting machine to facilitate attachment of the creel yarns to yarns that are already running into the tufting machine. In this manner, yarns from a creel are attached to the yarns already threaded into a tufting machine and, upon continuing use of the tufting machine, are used in forming the tufted products. A detachable header, in other words, can be used to provide a mechanism for aligning yarns for attachment (by fusing or otherwise connecting) to yarns already in a tufting machine.

On many creels, a detachable header is typically positioned and attached adjacent to a stationary header on the creel. Typically, when a yarn package is loaded onto the creel, its yarn is blown through a tube leading from the area of the yarn package to the stationary header, though a hole in the stationary header, and through an aligned hole in the detachable header that is adjacent thereto. This process is repeated until all yarns are through the detachable header, and then the creel yarns are then attached to the ends of yarns already threaded into the tufting machine as described above.

While using creels in this manner provides many benefits, it limits the efficient use of the creel since a given creel is subjected to significant down time (away from a tufting machine) for loading and unloading. Moreover, the process of loading yarn packages and sending yarns through tubes one at a time can be cumbersome and time consuming. Other techniques for loading a creel with yarn packages can be used, but all generally require a significant amount of labor.

In the manufacture of tufted products, significant labor may also be required to address issues presented by left over and excess yarn. Yarn is frequently left over on creels as a result of a tufting machine being reconfigured periodically to create different products, because a single tufting machine can be used to create multiple carpet products. For example, a tufting machine may first be configured to tuft 10,000 square yards of a first style in a first run, then reconfigured to tuft 800 square yards of a second style in a second run, then reconfigured again to tuft 1,200 square yards of a third style in a third run, etc. Switching between styles on a tufting machine may involve switching which yarns are fed into the tufting machine, among other things. Such switching of yarns can be accomplished in various ways.

Reconfiguration of a tufting machine may require significant labor to stock or recycle yarn left over on creels. Thus, for example, after a given tufting machine run is complete, new yarn must be loaded into a stationary creel or, if movable creels of the sort described below are in use, a new creel may be positioned adjacent to the tufting machine and the yarn ends from that creel may be fed into the tufting machine to begin the process of tufting a new run of a different style or color. Such reconfiguration is particularly common in make-to-order manufacturing processes but is also common in make-to-stock and other manufacturing processes. After a run is complete, the creel in use may have significant amounts of yarn remaining on its bobbins or yarn packages. In many cases, the various bobbins remaining on the creel will have differing amounts of left over yarn because of uneven use of yarn within the particular carpet style and/or uneven yarn amounts on the initial bobbins loaded onto the creel prior to the run. Extra yarn that is present after the run is completed may be unwound and then used to create new bobbins or yarn packages for future use, recycled, or used for another purpose. Such processes are generally very labor intensive.

Various improved creels have improved the efficiency and effectiveness of using yarn on tufting machines. For example, U.S. Pat. Nos. 6,634,585, 7,004,415, and 7,316,366 all entitled "Compact Creel," and naming William O. Ingram III as inventor, and all incorporated herein in their entireties by this reference, describe various compact creel innovations that facilitate use of yarn with tufting machines, among other things. FIGS. 1-3 illustrate an exemplary highly mobile, compact creel 20 that utilizes a frame 22 for holding yarn packages 30. This compact creel 20 includes a frame 22 having a front portion 24 and a rear portion 26, multiple hollow supports 28 attached directly to the frame 22 for holding yarn packages 30, and an attachable header 32. Casters 34, 36, 38, 40, 42 and 44 on the bottom of the frame 22 provide for ease of movement of the compact creel 20. During setup of the creel 20, an end of a strand of yarn 33 is unwrapped from the yarn package 30. The yarn 33 is blown through the flexible tubing 50 up to the header 32. The flexible tubing 50 runs behind the frame 22 and traverses up to the header 32. The header 32 provides for aligning all the yarn ends in the same plane and facilitates joining the yarns to ends already threaded into the tufting machine represented by dash line 58. Specifically, yarn 33 feeds through the flexible tubing 50 to the header 32, and through the slots 56 in the header to the tufting machine. The arrangement of the header 32 and slots 56 ensures that yarns feeding into the tufting machine 58 lie in the same plane. The header 32 includes a first plate 70 and a second plate 72 (FIG. 3). The flexible tubing 50 threads through the first plate 70 and abuts the second plate 72. The second plate 72 may be removable to facilitate attachment of the yarn to yarns already in the tufting machine.

In spite of the many advantages of the above-described compact creels, it is still generally desirable to reduce the labor required and otherwise improve the devices and processes that are used to provide yarn for use on tufting machines. Known processes for providing yarn to tufting machines and otherwise using creels generally require significant factory space and other resources. More efficient, effective, and less wasteful processes and devices for providing yarn for use on tufting machines and otherwise using yarn creels are generally desirable.

BRIEF SUMMARY

The terms "invention," "the invention," "this invention" and "the present invention" used in this patent are intended to refer broadly to all of the subject matter of this patent and the patent claims below. Statements containing these terms should be understood to not limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the appropriate portions of the entire specification of this patent, any or all drawings and each claim.

This invention relates to the processes associated with handling and positioning yarn packages so that the yarns in the packages can be supplied to a tufting machine, left over yarn can be effectively handled and new yarns can be supplied to the tufting machine from a new group of yarn packages or other sources. The apparatus of this invention, like previous movable creels, includes racks that hold yarn packages or partial packages.

By contrast, however, with previous portable creels in which each yarn package was mounted on a holder permanently attached to the creel rack, in some embodiments of the invention, yarn packages are positioned on holders within a "crate" or tray or other container that is attached to, supported by, or positioned within the creel rack together with other similar trays. Specifically, the rack may comprise a frame configured to receive a plurality of insertable/removable trays of yarn packages. The insertable/removable nature of the trays relative to the frame is such that the trays can be separately loaded with yarn packages in locations remote from the creel racks and tufting machines, if desired. Such a location could be at a yarn manufacturing operation or a package rewinding operation, among many other alternatives.

The use of trays of two or more yarn packages in apparatuses and processes providing yarn to tufting machines can reduce tufting machine, creel and other apparatus down time, permit changes in the locations at which particular yarn handling activities occur, significantly reduce the amount of yarn handling required, and facilitate handling and properly locating yarn of different colors. For example, a creel can be used with a first set of trays to feed a tufting machine while another set of trays is loaded with yarn packages. After use of the first set of trays with the tufting machine, the first set of trays can be quickly replaced within the creel with the second set of trays such that use of the creel can resume again. Such a replacement, because there are fewer trays than individual yarn packages, can be accomplished more quickly than in previous yarn-providing processes in which yarn packages were individually removed from and then loaded onto a creel. In addition, the use of trays reduces inventory, the number of operators required, and allows flexibility in how and where the trays can be loaded (e.g., can be loaded by external vendors).

The configuration and features of a creel facilitate provision of the yarns from the individual yarn packages to the tufting machine. The rack of the creel attaches, supports, or positions trays such that it is feasible and convenient to use the yarns from the individual yarn packages. To facilitate the attachment of individual yarns from the creel to individual yarns already feeding into the tufting machine, which is one technique for initiating use of the creel's yarn by the tufting machine, the creel is configured to automatically or semi-automatically position each of the individual yarns such that the positioned yarns can be more easily attached to those feeding already into the tufting machine. Specifically, the yarns are individually moved along paths from their respective holders to one or more alignment mechanisms, such as a header, on the creel at which the yarns are aligned or otherwise positioned for convenient and efficient attachment to yarns already feeding into the tufting machine.

To provide such paths for the yarn to be moved without interfering with one another, the rack of the creel comprises tubes preferably extending from positions near the individual yarn packages to positions at one or more alignment mechanisms. The rack is configured so that trays attached to or supported by the rack are positioned such that the individual yarns from their respective yarn packages can be inserted easily and without interfering with one another into individual tube ends during the creel loading process. Once positioned in the tube ends, the yarns are moved through the tubes to extend through the one or more alignment mechanisms, e.g., headers, and subsequently attached to yarns already feeding into the tufting machine.

The trays used to hold or support two or more yarn packages may have characteristics that provide various advantages. A tray can be configured with characteristics that minimize its size and weight and maximize its strength and yarn package support capabilities. The tray may comprise features, such as holes and indicia, that allow the contents of the tray to be observed and identified. The tray provides features that facilitate proper use of the tray with a rack and that facilitate efficient storage and transportation of the trays, for example, by allowing multiple trays to be stacked on top of one another and allowing trays to be transported by a fork lift or other machinery.

The alignment mechanisms of the creel may comprise one or more headers generally used to facilitate connection of yarns into a tufting machine or onto a beam. The header may be positioned on or near a top or side of the creel rack, or may be positioned in any other location appropriate for the intended use or uses of the creel. In addition to aligning yarns, the one or more headers of the creel can provide additional functionality. In one embodiment, a header mechanism is used to cause and control the movement of yarn during creel setup with new yarn packages. In some embodiments, the header mechanism uses suction or air pressure to cause individual yarn ends positioned within tube entrances near the yarn packages to move through the tubes and to the locations more convenient for attachment to a tufting machine. For example, a suction mechanism can be used to cause the individual yarns to move individually or in groups through the tubes such that, after being moved, the yarns extend in an aligned arrangement for convenient attachment to yarns already feeding into a tufting machine. While such a header mechanism can be used on a creel comprising a rack and trays as described above, the header can alternatively be used in other creels including, but not limited to, with creels configured to individually receive yarn packages rather than trays of yarn packages. The header mechanism used for moving yarns may be configured and positioned as an intermediate header, i.e., positioned between a stationary header and a detachable header such that the yarn is pulled through the tubes that terminate at the stationary header, through the intermediate header, and then through the detachable header. Once the yarns are pulled through the detachable header, the detachable header is removed and used to attach those aligned yarns to yarns already feeding into the tufting machine.

BRIEF DESCRIPTION OF THE DRAWINGS

The specification makes reference to the following appended figures, in which use of like reference numerals in different figures is intended to illustrate like or analogous components.

DETAILED DESCRIPTION

Various innovations related to providing yarn for use on tufting machines and using yarn creels are disclosed herein. These innovations may be used in various combinations or separately. None of the features of any creel, header, or other component or any step of any process or method described herein should be considered essential or necessary to the disclosed invention. Rather this disclosure describes and enables various devices and methods that can include one or more of the various features presented herein to provide one or more of several possible benefits.

A. Frame for Holding Multiple Yarn Trays

Figure 1:
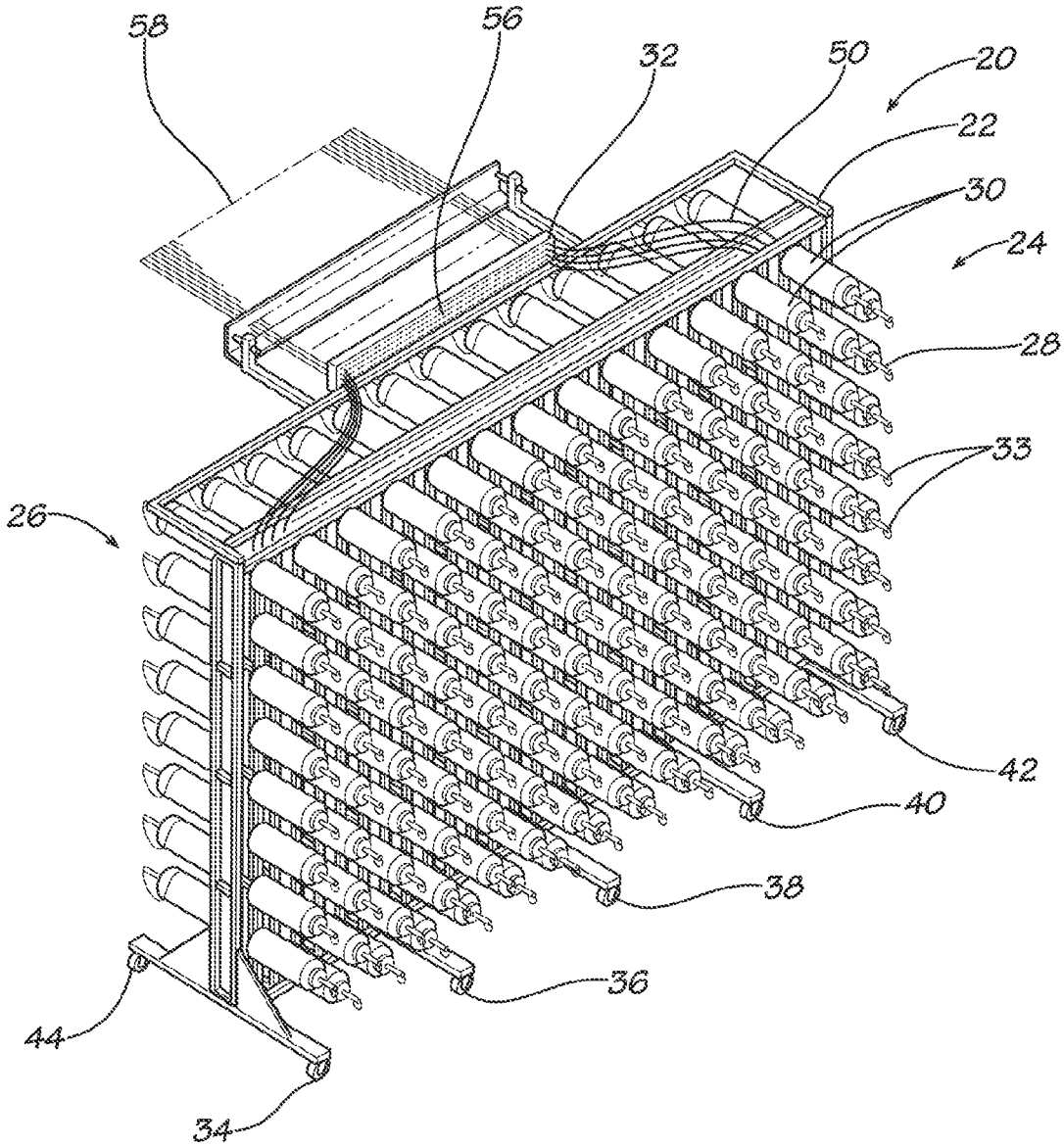
(PRIOR ART) FIG. 1
FIG. 1 is a front perspective view of a prior art compact, portable creel loaded with yarn packages.
Figure 2:
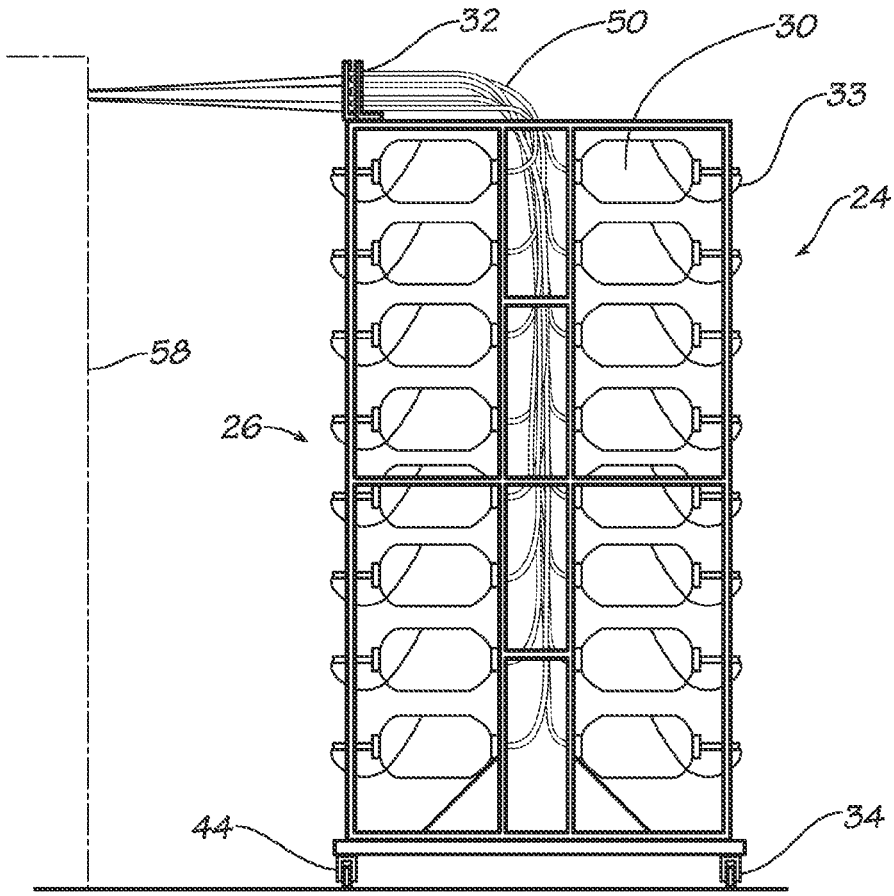
(PRIOR ART) FIG. 2
FIG. 2 is a side view of the compact creel of FIG. 1.
Figure 3:
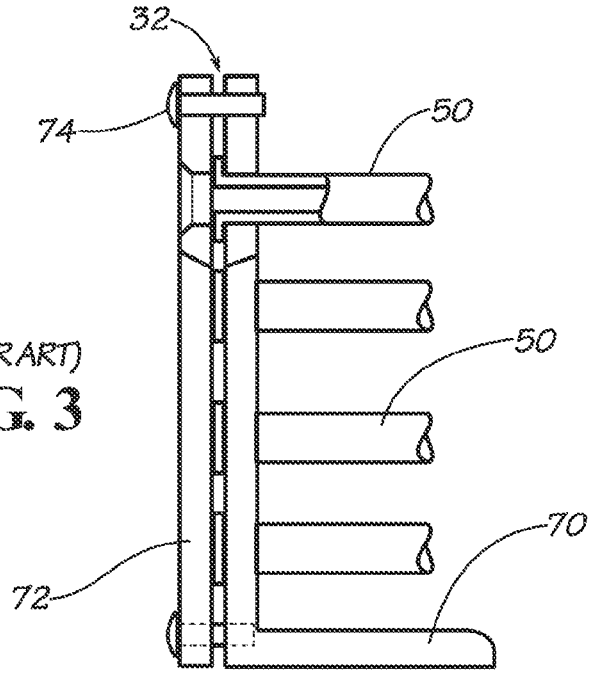
(PRIOR ART) FIG. 3
FIG. 3 is a partial view of the compact creel of FIG. 1.
Figure 4:
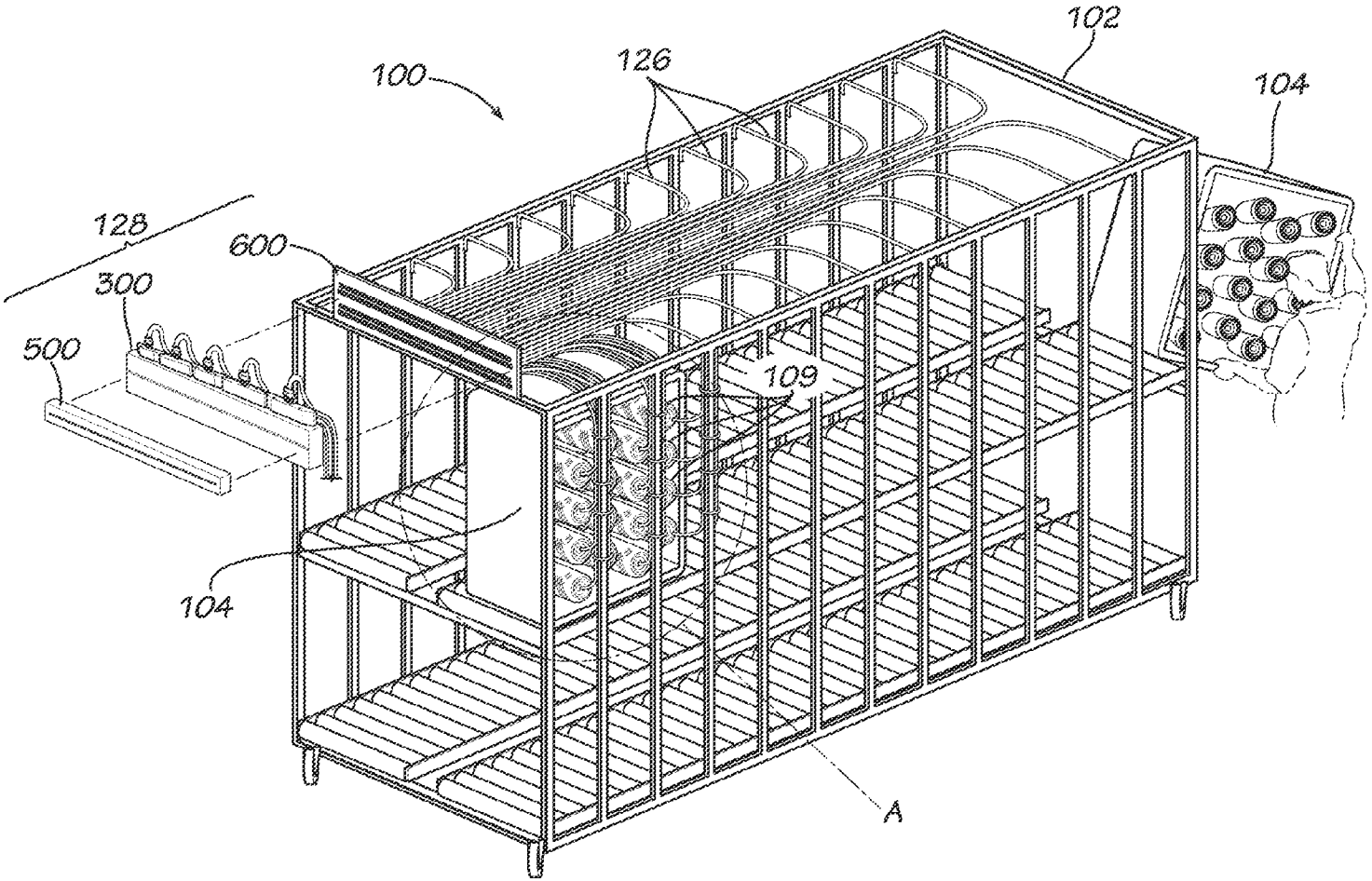
FIG. 4 is a perspective view of one embodiment of a header assembly and a compact creel of this invention as the creel is being loaded with trays containing a plurality of yarn packages.

Generally, disclosed below is a creel for feeding yarn from packages into a tufting machine FIG. 4 illustrates a creel 100 that includes a stationary header 600 positioned with respect to an intermediate header 300 and a detachable header 500. As described in detail below, the creel 100 utilizes a movable rack/frame 102 that receives a plurality of trays or containers 104 holding multiple packages of yarn 109. The yarn packages 109 are positioned proximate to an end of a tube 126 that is attached to the creel frame 102. The other end of the tube terminates in a header that is permanently attached to the creel (stationary header 600). FIG. 4 illustrates some of the ends of the tubes 126 as they are positioned relative to the yarn packages 109, but to make the Figure easier to under, it does not illustrate all tubes 126. In some embodiments, the creel 100 includes an intermediate header 300 (discussed below in Section B) and a detachable header 500 that facilitates the movement of yarn from the yarn packages 109 through tubes 126 through the intermediate header 300 and into the detachable header 500. The detachable header 500 can then be removed and attached to a tufting machine to connect the yarns moving through it with yarns already threaded into the tufting machine.

Figure 5:
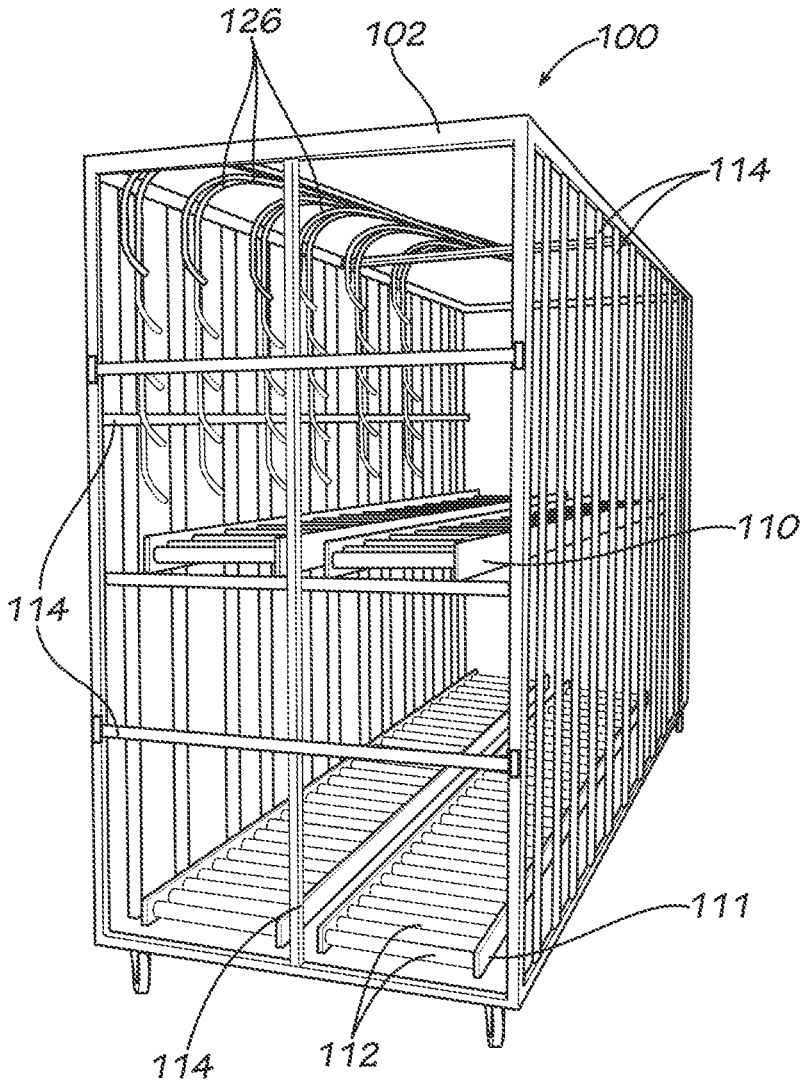
FIG. 5 is a perspective view of an end and one side of the compact creel of FIG. 4, illustrated without the trays.
Figure 6:
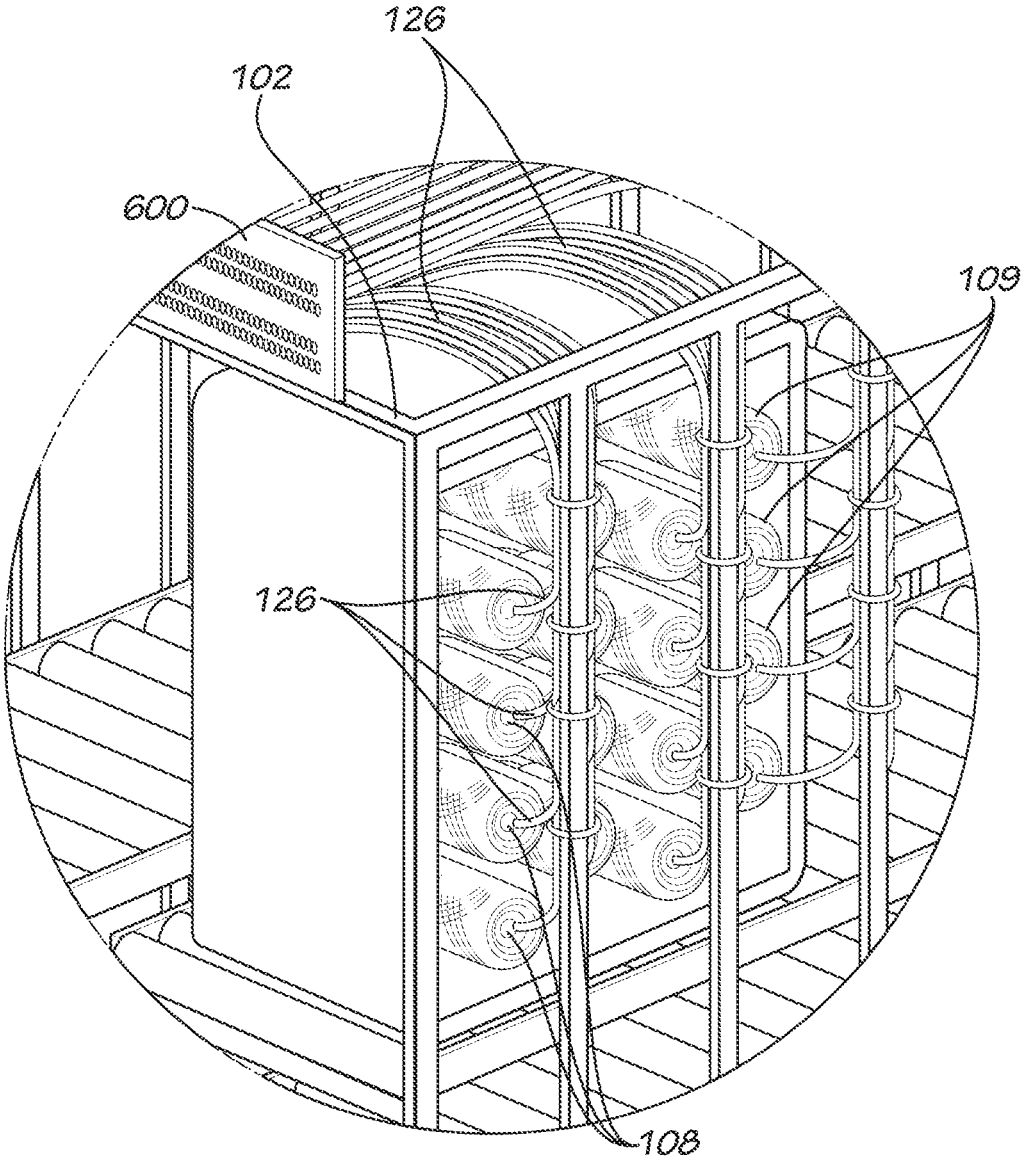
FIG. 6 is an enlarged view of a portion of the creel of FIG. 1, taken at inset circle A.
Figure 9:
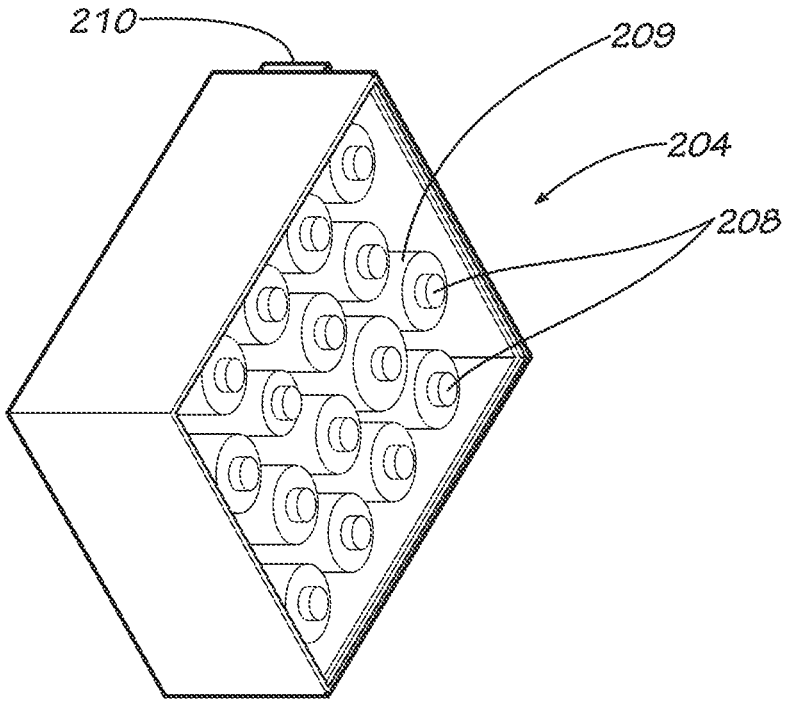
FIG. 9 is a top perspective view of a tray according to one embodiment.

Creel 100 shown in FIGS. 4-6 includes a frame 102 that receives and holds removable trays or containers 104, as shown in FIGS. 6 and 9. In some embodiments, frame 102 is configured to hold twenty-four (24) trays 104, although frame 102 may be dimensioned and sized to hold any reasonable number of trays 104.

Yarn packages 109 are located in trays 104, and trays 104 are positioned back to back and at two different heights in creel 100. This positions yarn packages facing "out" on opposite sides of the frame 102 at readily accessible heights above the floor so that yarn ends can be easily led manually (or alternatively though an automated process) from the packages 109 into yarn tubes 126 attached to frame 102, one of which tube 126 terminates at an appropriate position adjacent to each yarn package (see, e.g., FIG. 6).

Trays 104 are each configured to hold multiple bobbins or packages of yarn, one of which is positioned on one of the plurality of yarn package holders 108 attached to each tray 104. As one example shown in FIGS. 6 and 9, each tray 104 may be configured to hold sixteen packages of yarn, although tray 104 may be dimensioned and sized to hold any other suitable number of packages of yarn, depending, in part, on the size and weight of the yarn packages and on the operations requirements. In another example, the tray is dimensioned to hold twenty yarn packages or any other suitable number. FIG. 6 illustrates tray 104 and its yarn package holders 108 after it is loaded with yarn packages. As shown in FIG. 9, yarn packages having different lengths of yarn may be received on tray 104.

Although the configuration of the currently typically available yarn packages suggests use of yarn package holders 108 of some sort, yarn packages could conceivably be configured so that holders are not required or significantly different ways of positioning and retaining the packages in the tray 104 are utilized, provided that the package is secured in an appropriate location and that yarn feeds off of the package smoothly.

Tray 104 may be formed of a combination of metal and plastic or other materials so that the tray is relatively light in weight while retaining sufficient strength, integrity and resilience to withstand the relatively rough usage the trays 104 are likely to experience. The sides of tray 104 may be penetrated by holes or have other openings to reduce the weight of the tray and/or to make the yarn color visible through the holes. Yarn package holders 108 may be inserted into a tray by securing them in appropriate positions on a base of the tray with bolts, threaded rods, or other appropriate fasteners or mounting arrangements. For instance, trays 104 can be molded with sockets that receive an end of a holder 108. The yarn package holders 108 are made of metal, plastics, composites or any other suitable materials and may be specifically molded or otherwise fabricated for this application or fabricated from other existing materials. For instance, yarn package holders 108 may be made from appropriate lengths of PVC pipe split to flare pipe wall segments adjacent to the tray 104 base 130 to which they are attached. Tray 104 may be configured with openings and/or transparent or translucent material to facilitate identification of tray contents. A tray may be configured to allow adjustment of the positions, angle, and other attributes of the yarn package holders 108. In some embodiments, the tray 104 is the same shape and size as a pallet, to allow for easy loading onto a pallet and to facilitate handling with conventional pallet handling equipment and shipment and storage with conventional palletized materials.

Tray 104 may have any suitable structure for receiving and holding yarn packages so those packages can be oriented together in the frame 102. For example, a tray could comprise a plate with posts protruding from one or both faces of the plate, a bent wire structure for holding yarn packages, a two-sided structure for use with a frame that is slightly wider than the tray, etc. Tray 104 may be manufactured in a wide variety of ways and using a number of alternative materials, including injection molded plastics among many other suitable methods and materials. Both tray 104 and yarn package holders 108 may be formed of any suitable metal, plastic or other material and may be integrally formed with the tray 104 or separately fabricated and appropriately attached to the tray.

As shown in FIG. 5, frame 102 includes pairs of upper shelves 110 and lower shelves 111 to receive and support trays 104. Shelves 110 and 111 may be roller conveyer structures that include rollers 112 to facilitate sliding trays 104 onto and along shelves 110 and 111. For example, a first tray 104 may be pushed into the frame 102 and pushed further into the frame 102 on the rollers 112. A second tray can then be positioned similarly and pushed into the frame 102 on same shelf 110 or 111 and, in the process, the second tray pushes the first tray further into the frame 102. A similar tray loading process can be repeated until the entire shelf 110 or 111 is filled or otherwise provided with a desired number of trays. Moreover, empty or partially empty trays can be unloaded at the same time that new trays are loaded. Fewer or more shelves 110 and 111 can be included within frame 102 depending on the size of the frame and the sizes of the trays 104 used within a particular frame 102.

Frame 102 may also include a plurality of bars 114 along one or more sides of the frame to help contain the trays 104 within the frame 102, to provide sufficient structure to adequately support shelves 110 and 111, and to provide attachment points for the yarn tubes 126. The bars may be single bars or double bars. Any suitable number of bars in any suitable orientation may be used to help contain trays 104 within frame 102 and provide the structure and support needed. Bars 114 on the front side of the frame 102 should be positioned so not to obstruct the removal and insertion of a tray 104 into frame 102. The trays 104 are typically loaded into frame 102 so that the trays face outwardly toward a right or left side of the frame 102. Each tray 104 is typically inserted into the frame 102 from at least one of its ends, as shown in FIG. 4. In this example, trays are loaded onto the frame manually. In other embodiments, conveyers and other mechanized devices can be used to load or facilitate loading of the trays.

As mentioned, trays 104 are removable from the frame 102 and thus can be loaded with packages of yarn when the tray 104 is not in the frame (e.g., before the tray is inserted into the frame). The ability to separately load trays 104 with yarn packages can simplify and provide other benefits with respect to the process of loading a creel, such as creel 100, with yarn packages. For example, instead of having to load many individual yarn packages separately on the creel as had been done generally in the past, loading the frame of a creel can simply involve loading in the frame 102 a relatively small number of trays (such as trays 104) that were themselves already loaded with the individual yarn packages. Since less time may be required to load a frame, the frame can be in active use providing yarn to tufting machines or beams for a greater percentage of the time. A manufacturing operation may require fewer creel frames than it otherwise would since each frame can be used more efficiently. Trays may be easier to load with yarn packages, and may be loaded with yarn packages in other locations and at other times than if the packages have to be mounted directly and separately on a creel frame. Moreover, such tray loading may be accomplished with less skilled workers who do not have to master the complexities of loading yarn directly on a creel and inserting yarns in yarn tubes and passing the yarn through headers. Although the loading of the yarn packages into the tray 104 may be done manually, the process may also be automated. Similarly, the loading of the trays 104 into the frame 102 may be done manually or may be automated, and the cutting and separating of the yarn ends and reattaching the ends with yarn already threaded into the tufting machine may be partially or completely automated. Trays and frames may also be loaded with yarn packages after the trays are loaded (empty or partially empty) into the frame.

Trays can also be staged separate from the frames used to house them. By storing and staging the trays in a predetermined manner, factory management can be enhanced to provide further benefits and optimizations within the supply chain. Preloaded trays may also be used as design building blocks, for example, in the context of computer aided design. As yet another benefit, because the number of trays can be different from the number of frames, a major constraint to work in process (WIP) yarn can be eliminated. By removing this constraint, operational productivity may increase as operational costs decrease.

Figure 10:
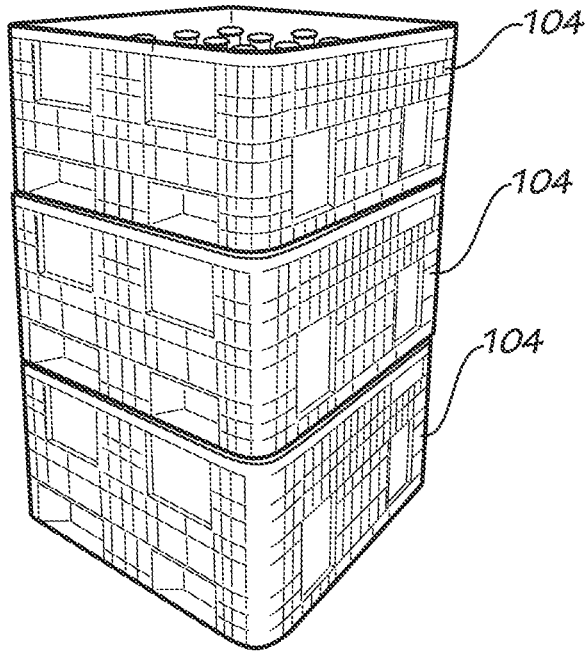
FIG. 10 is a perspective view showing three stacked trays.

The ability to separately load trays with yarns also provides benefits with respect to yarn storage. The individual trays can be loaded with yarn and then stored for use when needed. Such trays may be configured for more efficient use and storage. For example, trays may be configured to provide more space efficient storage than a conventional creel loaded with yarn. Trays may be configured for transport using fork lifts (FIG. 11), conveyer belts, and other devices and may be sized to take advantage of warehouse space (e.g., such as warehouse shelves) that loaded creels generally cannot take advantage of given their size and shape. As shown in FIG. 10, trays may be configured to stack on top of one another or to otherwise minimize storage space.

FIGS. 4 and 6 illustrate tubing 126 used to receive and guide yarn from the yarn packages in the trays 104 to header assembly 128. In some embodiments, the tubing is nylon antistatic tubing, although the tubing may be formed of any suitable material that can be conformed to the desired yarn paths. In some embodiments, the tubing 126 can run along an element of the frame 102. Alternatively, frame 102 may include an interior space through which the tubing 126 can run.

Figure 7:
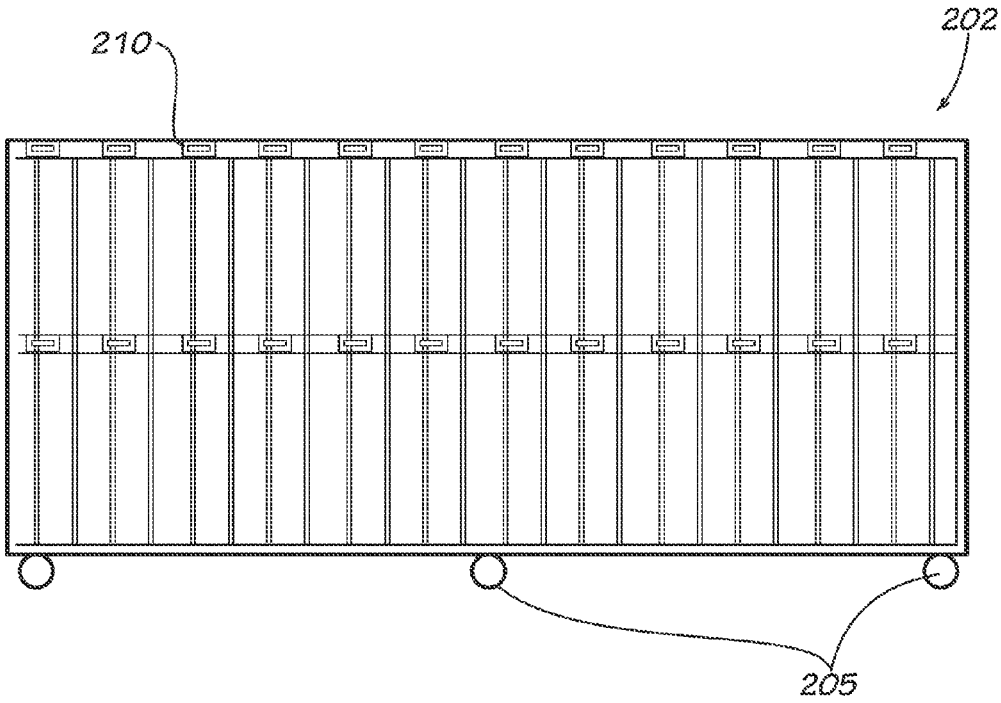
FIG. 7 is a schematic side view of a creel according to another embodiment.
Figure 8:
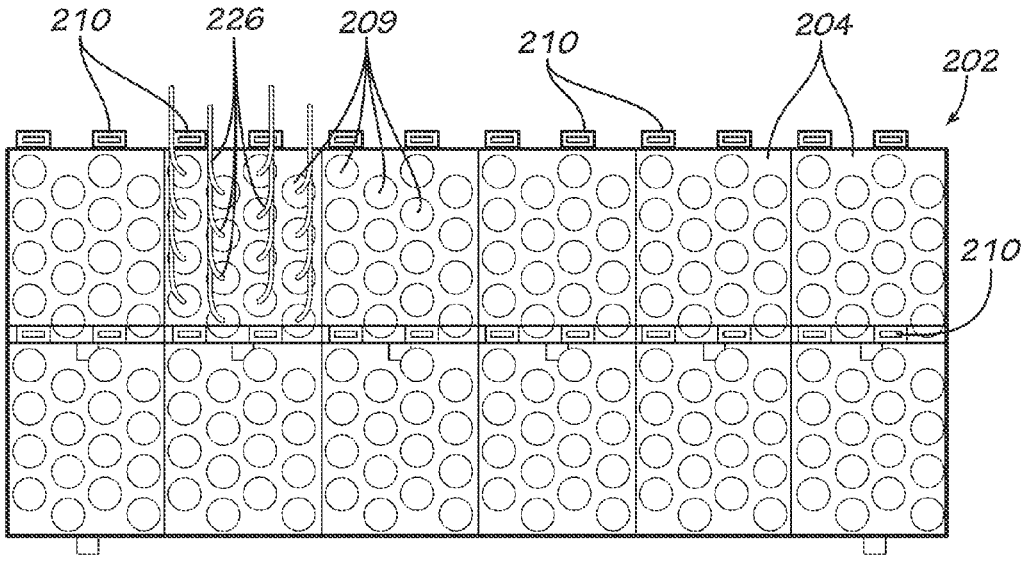
FIG. 8 is a plan side view of the creel of FIG. 7, shown loaded the trays.
Figure 11:
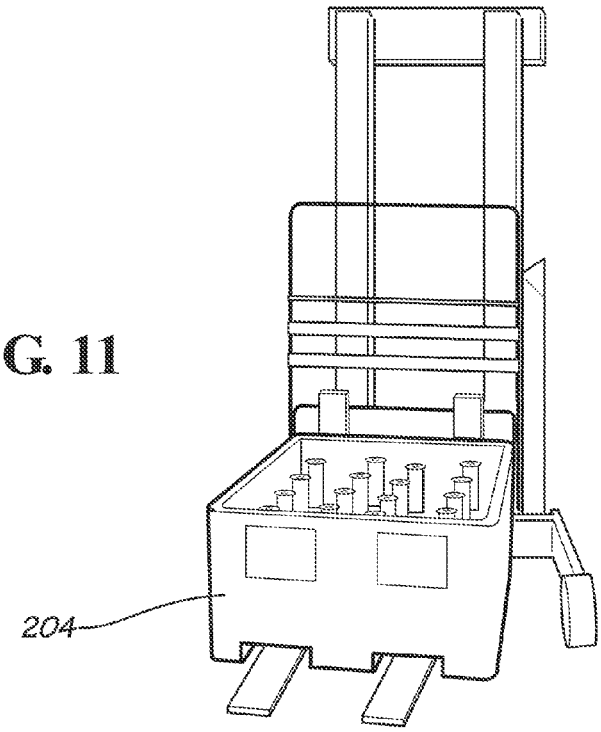
FIG. 11 is a perspective view of a tray positioned on a fork lift.

FIG. 7 is a schematic side view illustrating another embodiment of a frame 202. Frame 202 can have various configurations. FIG. 8 is schematic a side view of the frame 202 after it has been loaded with trays 204. Trays 204 are configured to hang within the frame 202 rather than slide along the two rows of shelves with rollers. The ends of the tubes 226 (only some of which are shown in FIG. 8) substantially align with the center of the yarn package 209. Similar trays could alternatively be stacked within the frame, i.e., with a first row of trays on the bottom providing support for a second row of trays that is positioned directly above the bottom row, or could hang on a wall using any suitable attachment mechanism such as a trolley system or suspension system. FIGS. 7-9 schematically illustrate an attachment mechanism 210 that can be used to hang the trays 204 within frame 202. As illustrated in FIGS. 10-11, sidebars, such as bars 114 that were used with frame 102, are not necessary because trays 204 hang within frame 202.

Although specific examples of a suitable frame structure have been described and illustrated, there are many different frame configurations that can be used to receive a plurality of trays 104 and to route yarn from yarn packages housed on the trays 104 to a marshalling point (such as a header assembly 128).

As shown in FIG. 7, frame 202 may include caster or other wheels 205 or other components that facilitate moving the frame within a manufacturing facility. Moreover, a frame may be configured to be transported by attachment to or other interaction with a truck or lifting device.

FIG. 9 illustrates tray 204 in isolation and loaded with yarn packages 209. As shown, tray 204 includes sixteen yarn package holders 208 for receiving sixteen yarn packages 209. As mentioned above, tray 204 may be configured to hold any suitable number of yarn packages in any suitable orientation. Yarn package holders 208 may hold a yarn package in place using compression, friction, gravity, fixation devices, or any other suitable means of attachment or connection. Any suitable attachment mechanism may be used to attach tray 204 to frame 202.

Figure 12:
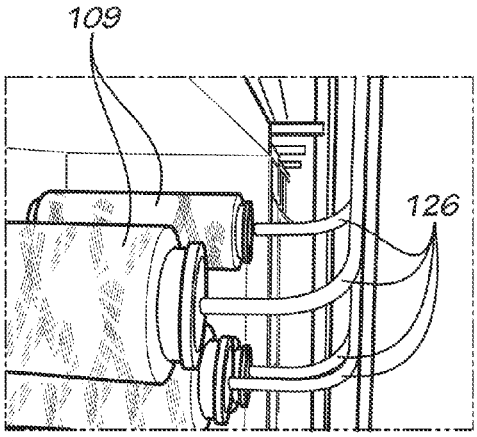
FIG. 12 is a partial view showing the spacing between yarn packages within a tray within a creel.

FIG. 12 illustrates the spacing between yarn packages 109 within a tray within one embodiment of a frame and the side of the frame upon which tubing (such as tubing 126) is provided for receiving the yarn from the yarn packages.

Figure 13:
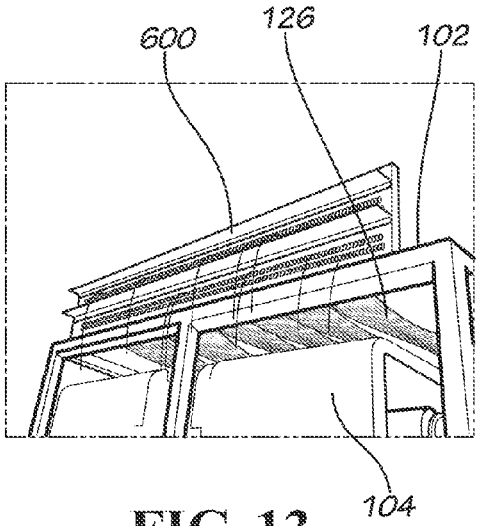
FIG. 13 is a partial views of a stationary header on a creel.

FIG. 13 illustrates a stationary header 600 on an exemplary frame 102 before the process of pulling yarns through the tubing to the header assembly 128 has been completed.

B. Improved Headers

Figure 14:
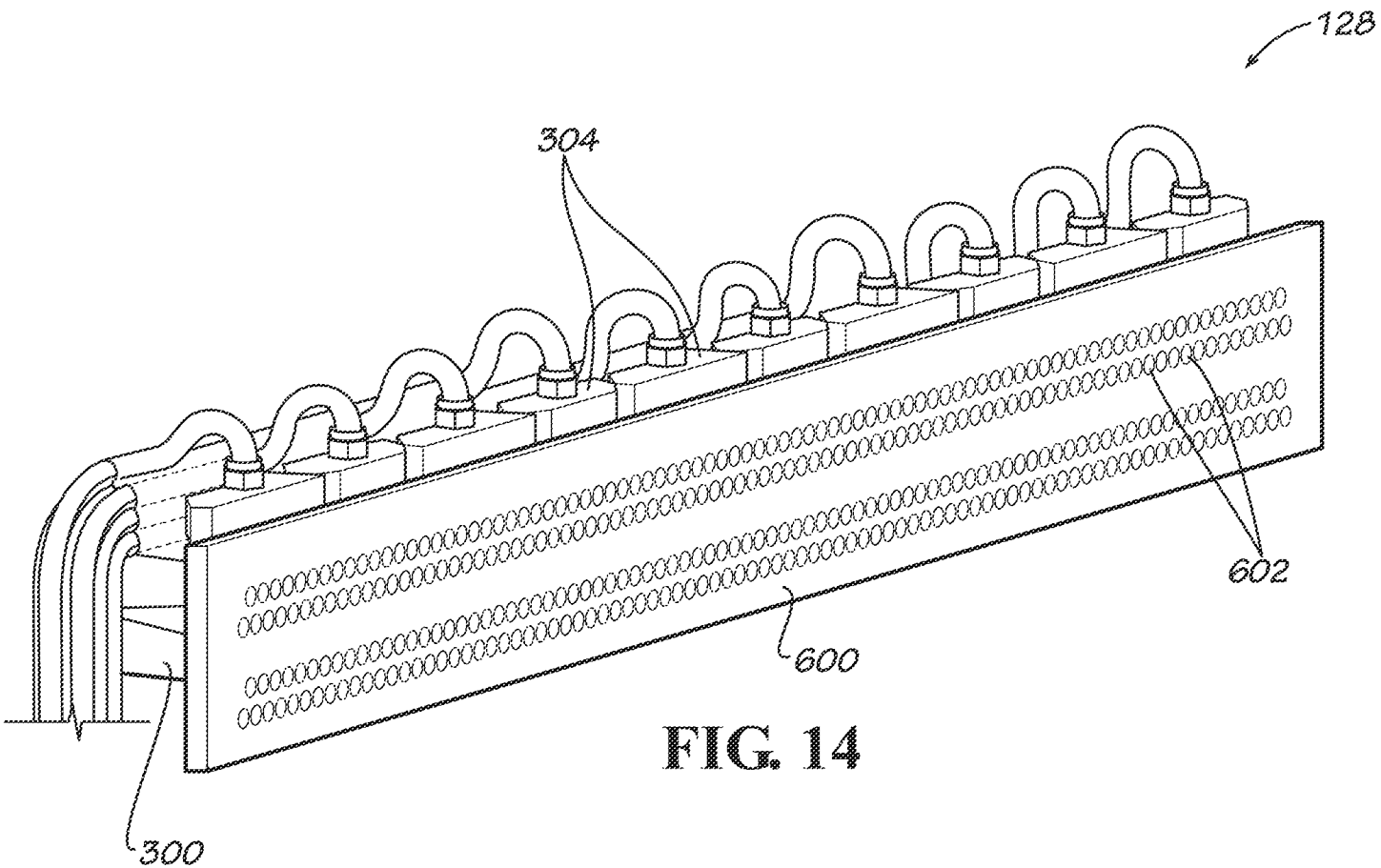
FIGS. 14-15 are front and rear perspective views of a header assembly according to one embodiment.
Figure 15:
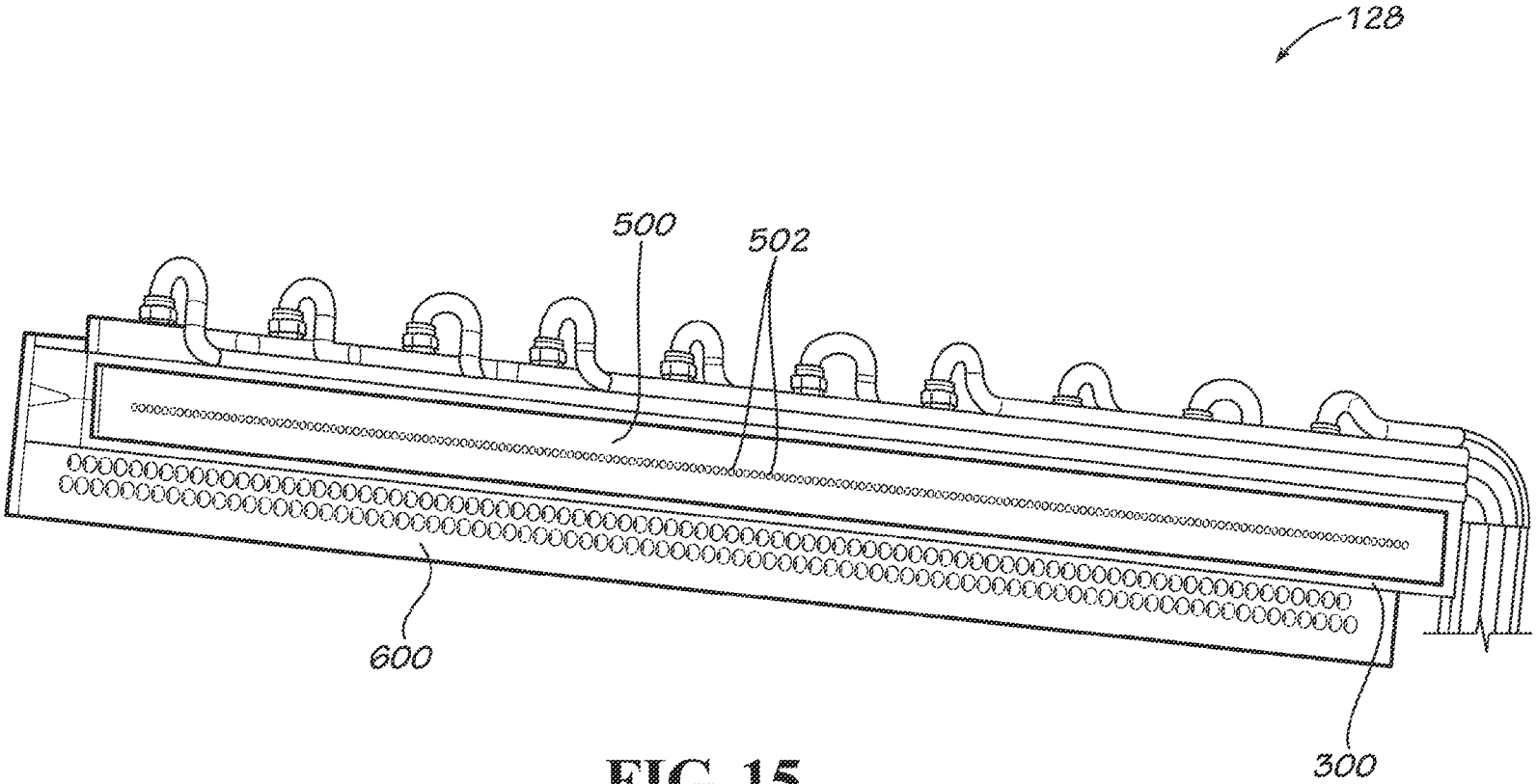
Figure 16:
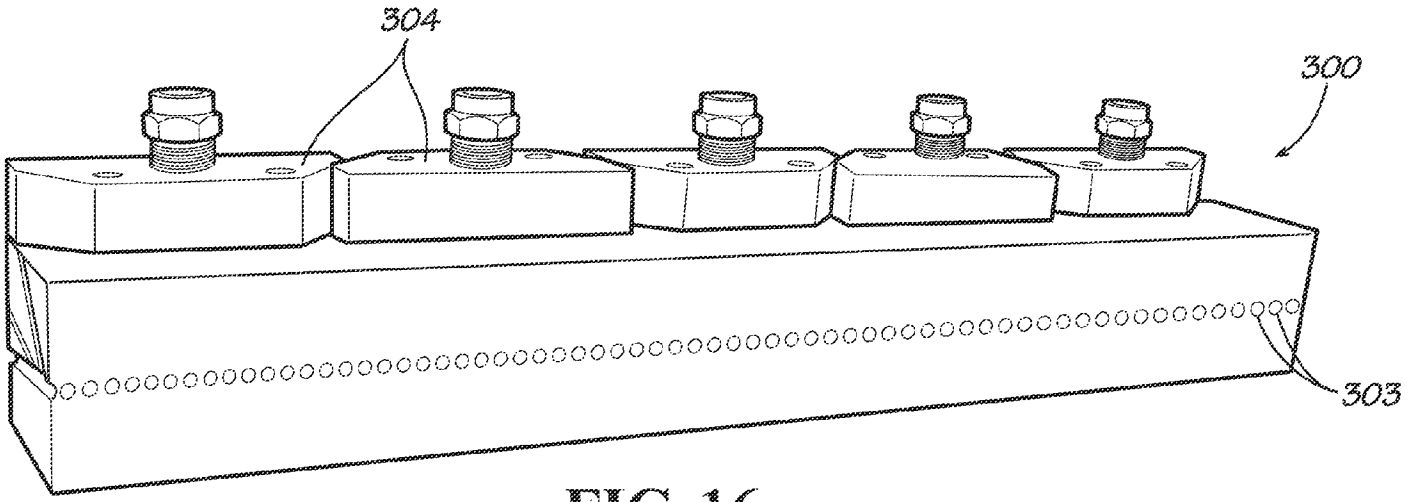
FIGS. 16-19 are various perspective views of an intermediate header of the header assembly of FIGS. 14-15.
Figure 17:
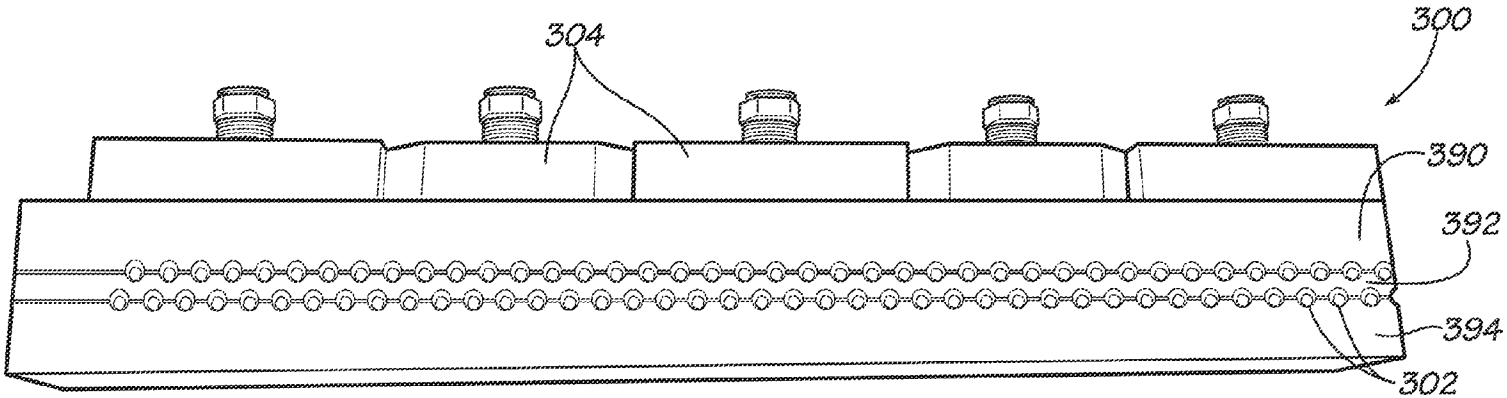
Figure 18:
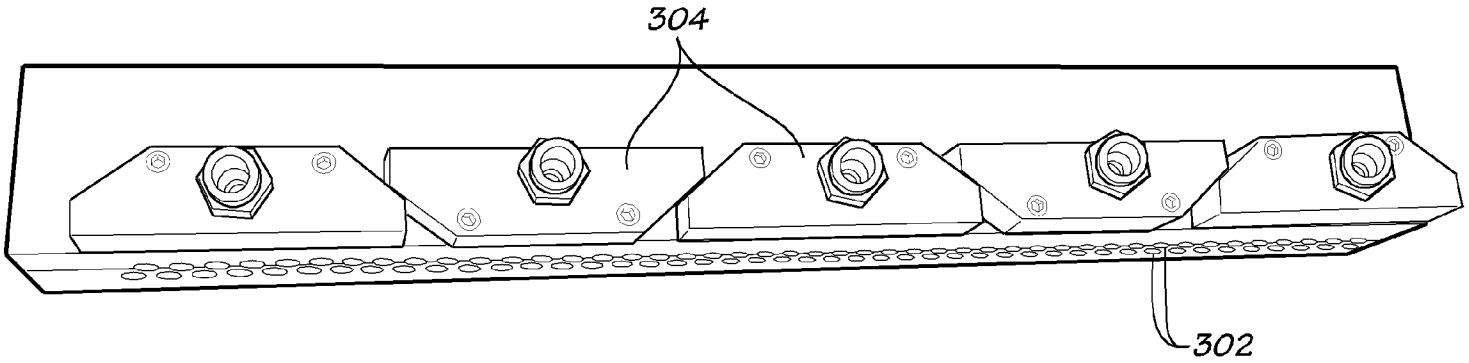

As shown in FIG. 4, creel 100 may include a stationary header 600, onto which or next to which an intermediate header 300 and a detachable header 500 may be assembled. FIGS. 14-15 show front and rear views of a header assembly 128, which comprises a stationary header 600, an intermediate header 300, and a detachable header 500. An intermediate header 300 for use with a creel is illustrated in FIGS. 16-17. FIG. 17 illustrates a first side of the intermediate header 300 that, when assembled into header assembly 128, is positioned adjacent the stationary header 600, while FIG. 16 illustrates a second side of the intermediate header 300 that, when assembled into header assembly 128, is positioned adjacent the detachable header 500. Intermediate header 300 includes a first set of holes 302. A second set of holes 303 is located on the second side of the intermediate header 300. After being blown up through the flexible tubing that guides each yarn from each yarn package, the yarn strands move through holes 602 in the stationary header 600 through the first set of holes 302 of the intermediate header 300 and through the second set of holes 303 of the intermediate header 300 and through holes 502 formed in the detachable header 500 (see FIGS. 14-17).

Such a header assembly can be used in a variety of different creel configurations, including those described above and others. In one configuration, an intermediate header 300 is used to facilitate loading yarns through a detachable header on a creel. In the embodiment illustrated in FIGS. 14-15, intermediate header 300 is positioned between a stationary header 600 attached to a creel and a detachable header 500.

Specifically, intermediate header 300 is used to facilitate moving yarn from the yarn packages on the creel through holes 502 in the detachable header 500 by inducing air flow through the yarn-containing tubes, which causes the movement of the yarns through the stationary header 600, the intermediate header 300, and the detachable header 500.

Intermediate header 300 also includes a plurality of ports 304 at the top of the header 300 that attach to one or more air flow sources (such as sources of conventional compressed air) that cause air to flow through the intermediate header 300. The differences in pressure caused by the air flow through the intermediate header in turns causes the yarns to move through the header. In this way, the air flow causes the yarns positioned on the creel to move through the tubing, through the stationary header 600, through the intermediate header 300, and through the detachable header 500. The yarn may move through the tubes using the Venturi effect or other suitable technique.

The use of multiple ports 304 allows air flow to be provided for only certain of the yarns at a given time. In particular, a given air source may be divided for separate use at each of the ports. The number of yarns a given port is configured to move can be selected based on the particular creel configuration and/or air flow source attributes (e.g., air pressure, etc.). The particular port configuration and air pressure selected can be determined based on the particular tube and header configuration.

Generally, a given port can be configured to provide air flow that causes pressure differences in more than one of the intermediate headers yarn holes 302 at a time. Yarn ends for multiple yarns can be positioned at the entrances of multiple tubes and the air flow for those multiple yarns can be initiated at the same time causing the yarns to move simultaneously. In another example, suction or vacuum or reduced air pressure is used to cause the desired yarns to move through the creel. Other embodiments may use air flow, suction, or other techniques at the intermediate header or elsewhere, and/or some combination of such techniques to cause yarns to move through the creel as desired. Other gases or fluids than air may be substituted for air as may be appropriate for the circumstances. In some embodiments, the air flow unit is not used at all. In embodiments where the air flow unit is not used, the intermediate header can be used to align the yarns moving through the headers and to provide an interface between holes of different gauges in the stationary header and the detachable header, as described below.

In the air flow example described above, once the yarn ends for all of the moving yarns have extended through the detachable header, the air flow for those yarns can be halted, and the user can proceed with loading the next group of yarns through the detachable header in a similar manner using the next air port. Once all yarns have been loaded, the intermediate header 300 can, but need not necessarily, be removed from the creel and used in loading yarns through a detachable header on a different creel. In certain embodiments, one or more of the observations or determinations and actions described in this example can be partially or fully automated.

Figure 20:
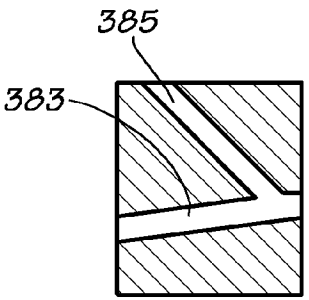
FIG. 20 is a cross-sectional view of the intermediate header of FIG. 19.
Figure 19:
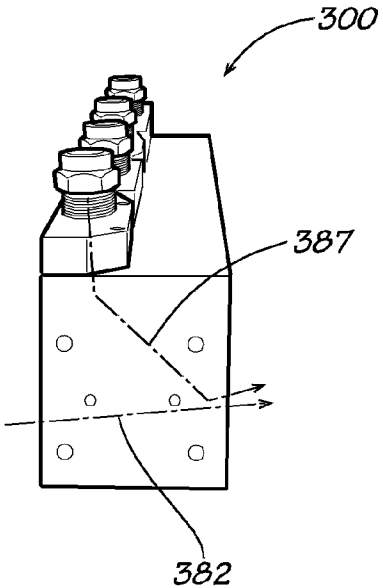

FIG. 19 illustrates a side view of intermediate header 300 and the yarn and air flow paths within the intermediate header 300, and FIG. 20 illustrates a cross sectional view of FIG. 19. In this example, the intermediate header 300 provides a passageway 382 for a yarn to be moved in the direction of arrow 382. Air flow through the intermediate header 300 is directed through passageway 385 in the direction of arrow 384 to cause a difference in pressure that causes the associated yarn to be pulled through the tube (not shown), through the stationary header 600, through the intermediate header passageway along the path of arrow 382 and though the detachable header 500 adjacent thereto.

Figure 21:
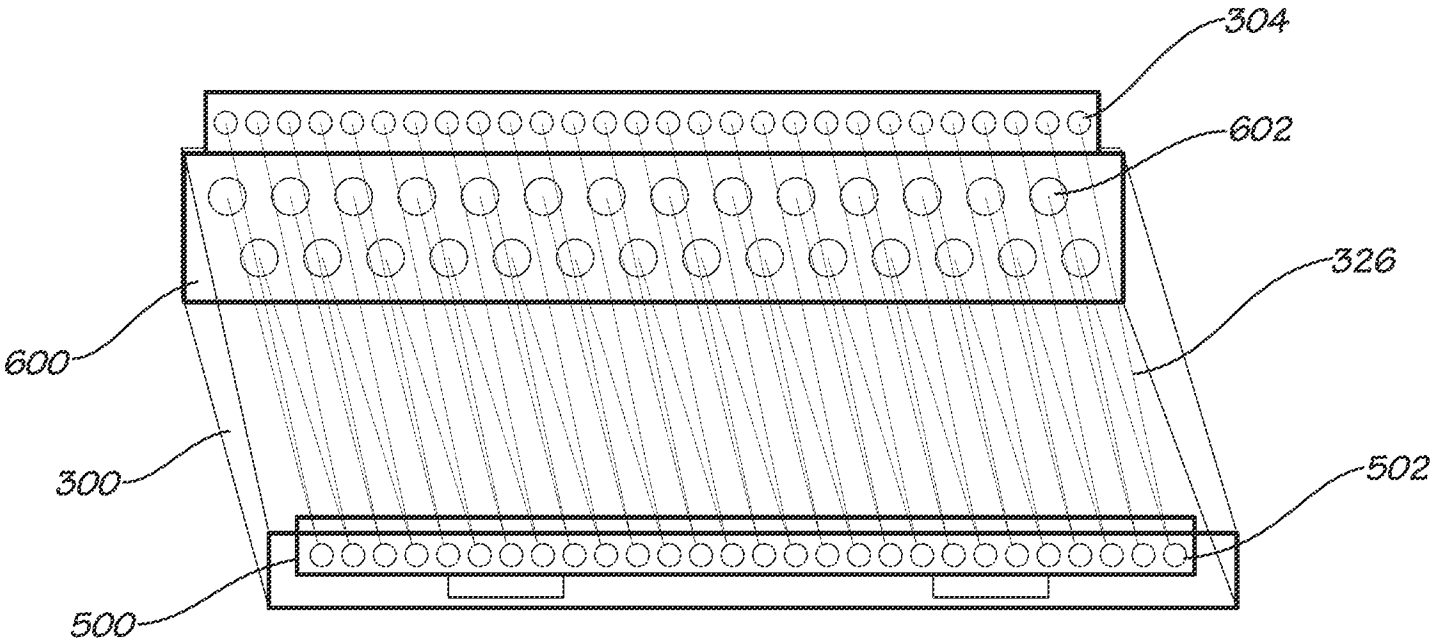
FIG. 21 is a schematic top perspective view of a detachable header, intermediate header, and stationary header.
Figure 22:
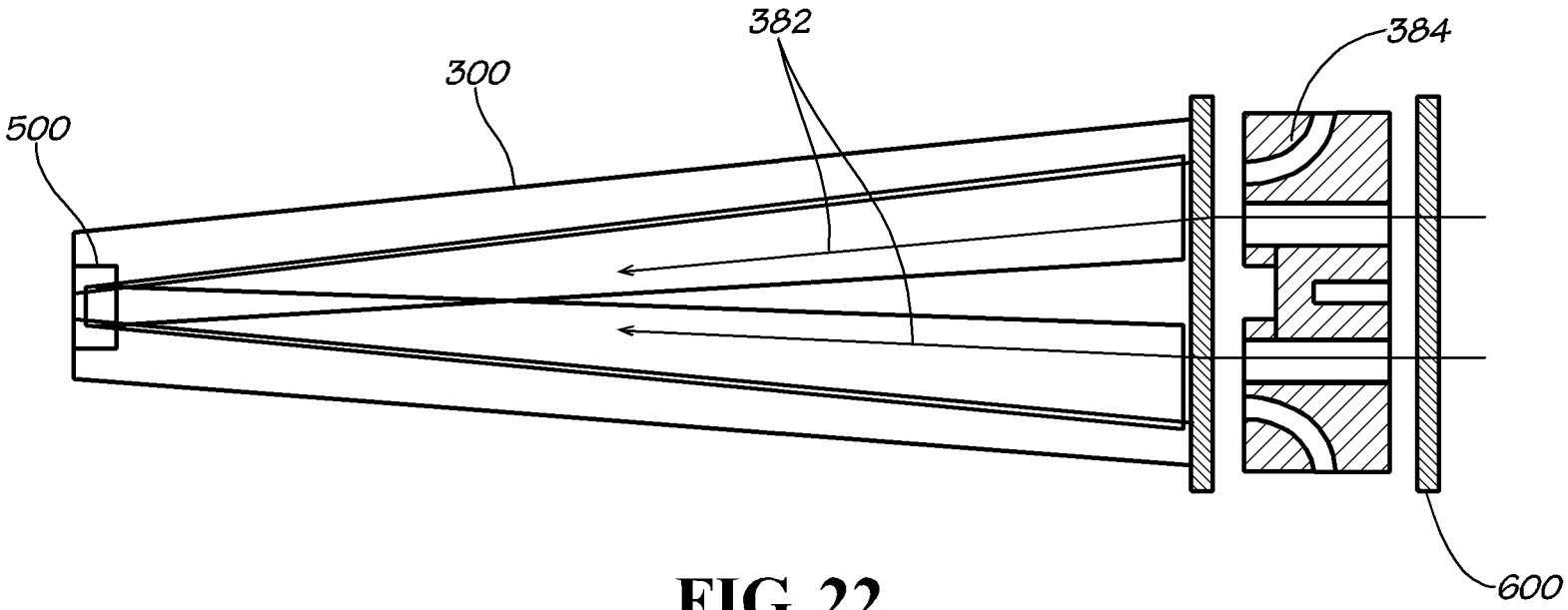
FIG. 22 is another schematic top plan view of the header assembly of FIG. 21.

FIGS. 21-22 schematically illustrate one non-limiting configuration of detachable header 500, intermediate header 300, and stationary header 600 (not drawn to scale). As illustrated, the intermediate header 300 can receive yarn from holes 602 in the stationary header 600 (FIG. 14) and provide passageways to corresponding holes 502 in the detachable header 500 (FIG. 15). In one embodiment, the holes 602 in the stationary header 600 are larger in gauge than the holes 502 of the detachable header 500. The intermediate header 300 provides an appropriate interface between these different gauges. As shown in FIG. 22, the air flows in the direction of air flow path 384 and causes the yarns to travel along yarn path 382.

Figure 23:
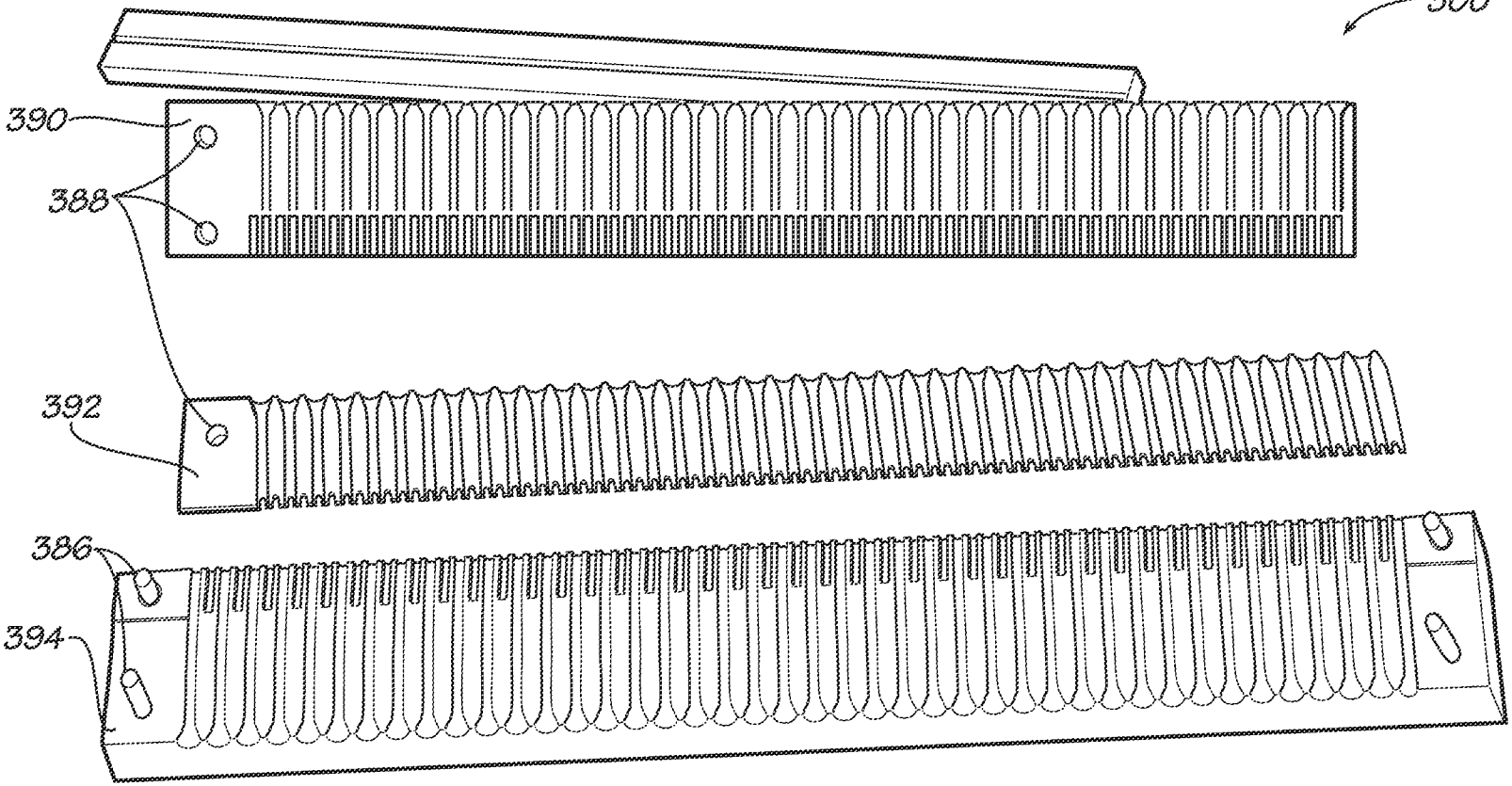
FIG. 23 is a perspective view of a disassembled intermediate header.

FIG. 23 illustrates intermediate header 300 after it has been disassembled into pieces 390, 392, and 394. The ability to disassemble such an intermediate header allows for removal of the intermediate header from a creel after yarns have been loaded, i.e., while yarns are still running through the intermediate header and, in some embodiments, after the yarns have moved through the detachable header. In this example, pins 386 and corresponding holes 388 are used to position and secure the different portions of the intermediate header to one another.

An intermediate header can be formed in a variety of ways. In one embodiment, the intermediate header is formed as a one piece or multi-piece injection molded component(s).

Figure 24:
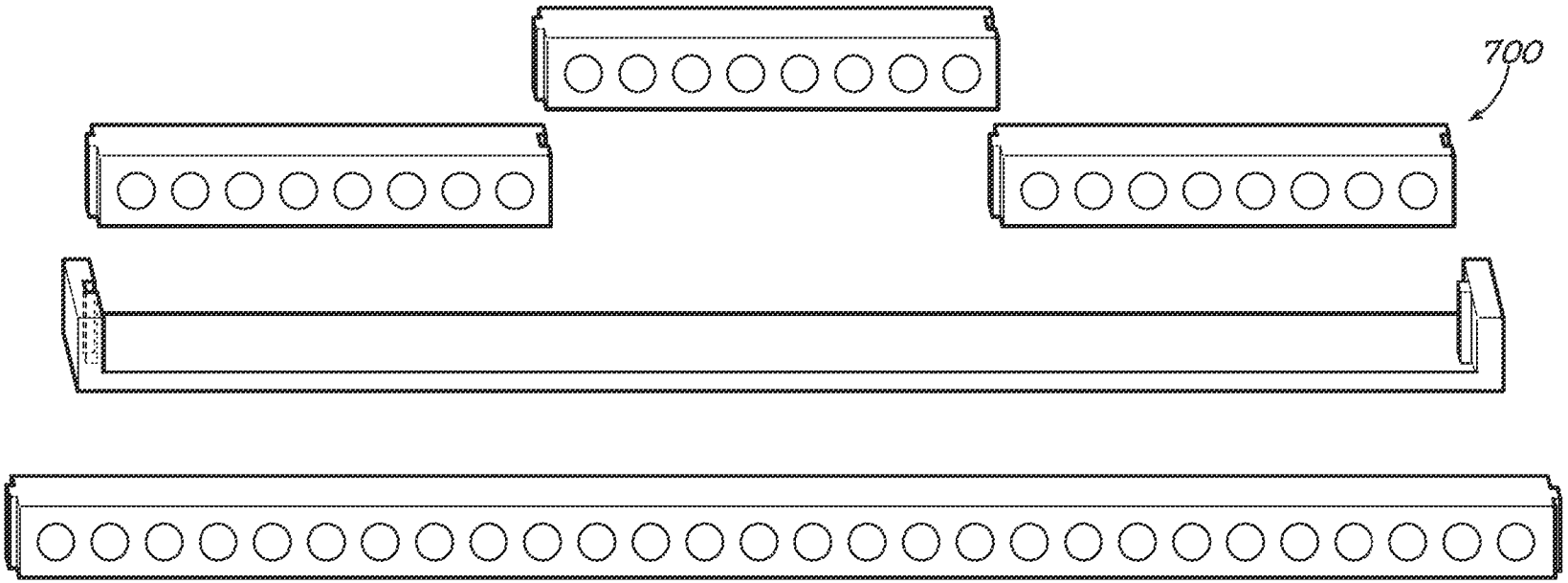
FIG. 24 schematically illustrates an intermediate header made of three pieces

FIG. 24 schematically illustrates a header 700 that can be provided in portions along its length to create multiple mini headers. Allowing the header to be attached in portions can facilitate changing only a portion of a creel, for example, to facilitate changing one run to another run without having to use a different creel and without having to reload all of the creel's yarns. For example, using mini headers can generally allow rearranging a run's thread-up at the detachable header rather than having to reload an entire detachable header. A variety of other uses and benefits can be achieved by using a header that can be separated into different mini header portions.

Any suitable air flow control may be used to control air flow with respect to an intermediate header, such as intermediate header 300. In certain embodiments, a user is able to control air flow with respect to an intermediate header to control the movement of yarns for loading yarns through a detachable header. For example, in certain embodiments, air flow controls are provided on the creel itself. An air flow control may provide one or more connection points for connecting to an air or suction source. The individual controls on the air flow control can then be used to control air or suction that is provided to each of the ports on the intermediate header. In other embodiments, air and/or suction may be provided and controlled in alternative ways.

C. Techniques for Planning Yarn Usage

Improved yarn inventory and planning techniques may be used. The amount of yarn in a yarn tray may be known and used in efficiently scheduling tufting machine runs. Scheduling may take into account available trays and color and/or yarn requirements to schedule one or more tufting machine runs.

As a specific example, if three orders are identified as requiring various amounts of purple yarn, a particular yarn tray may be selected to provide the purple yarn for two of the orders based on a recognition that the tray has sufficient yarn for both. The third order may be scheduled to use another tray. Such scheduling is particularly useful in improving make-to-order processes and in planning with respect to released and unreleased (i.e., unreleased due to an incomplete order or yarn not at the factory yet) orders. Planning can also involve scheduling use of different size frames based on order requirements. Portable creels with insertable trays may be used in conjunction with previous portable creels, beams or stationary creels to effectively extend their capacity. Planning software can be created and used to leverage this advantage.

A tufting facility may use different tufting machines that accept a different number of yarns as input. The use of a creel with a frame holding trays and/or an intermediate header may facilitate use of a given creel for multiple tufting machines by accommodating the machines' different yarn input requirements. For example, the frame may be configured to hold varying numbers and/or sizes of trays. Further, differing headers can be used to facilitate input into a respective tufting machine. For example, the number of yarn packages needed for a particular tufting machine dictates how many holes are needed in the detachable header 500, and the alignment and/or spacing of those holes. The embodiments described in this application allow portable creels with insertable yarn trays to be used universally across tufters of different gauges requiring different numbers of yarn ends.

The embodiments described above are illustrative and non-limiting. Many variations of the structures illustrated in the drawings and the materials described are possible and within the scope of this invention. For instance, the materials for the components described above may be metal or plastic or ceramic carbon fiber or any other suitable material or combination of materials. The materials may also have a coating applied to them.

The invention claimed is:

1. A creel comprising:

(a) a plurality of trays, each tray comprising sides and a base, and being adapted to hold a plurality of yarn packages;

(b) a frame comprising:

(i) a front portion and a rear portion opposite the front portion;

(ii) a first open end between the front portion and the rear portion;

(iii) a second open end opposite the first open end and between the front portion and the rear portion; and (iv) at least one shelf that substantially extends between the first open end and the second open end, the at least one shelf configured to receive the plurality of trays; and (c) a header on the frame for aligning yarns from the yarn packages for use by a yarn-using machine.

2. The creel of claim 1 wherein the plurality of trays are configured to be removable from the frame.

3. The creel of claim 1, wherein the at least one shelf comprises rollers for facilitating positioning of each tray on the at least one shelf.

4. The creel of claim 1 wherein the plurality of trays each comprise a plurality of yarn posts.

5. The creel of claim 1 wherein the sides of each of the plurality of trays comprise openings.

6. The creel of claim 1 further comprising tubing for transporting yarn from the yarn packages to the header.

7. The creel of claim 6 further comprising an air flow unit that causes yarn ends from the yarn packages inserted into ends of the tubing adjacent the yarn packages to move through the tubing to the header.

8. The creel of claim 7 wherein each of the plurality of trays is positioned such that individual yarns from the respective yarn packages of the plurality of trays can feed into one of the ends of the tubing without interfering with other yarns.

9. The creel of claim 1, wherein each of the plurality of trays further comprises a plurality of supports that are each configured to support one of the plurality of yarn packages.

10. A method for handling yarn to be used in a tufting machine comprising:

loading multiple yarn packages into each of a plurality of yarn package receiving trays;

loading the plurality of trays into a creel frame;

introducing into a first tube attached to the frame a first yarn from at least one of the multiple yarn packages loaded into a first yarn packaging receiving tray of the plurality of yarn packaging receiving trays;

introducing into a second tube attached to the frame a second yarn from at least one of the multiple yarn packages loaded into a second yarn packaging receiving tray of the plurality of yarn packaging receiving trays; and attaching the yarn from the first tube and the yarn from the second tube to the tufting machine.

11. The method of claim 10, wherein the step of loading the trays into a creel frame comprises sliding the trays into the creel frame from one end using rollers.

12. The method of claim 10, wherein the step of loading the multiple yarn packages into the trays is performed at a first location and the step of loading the trays into the creel frame is performed at a second location different from the first location.

13. The method of claim 10, further comprising the step of determining a needed location of one of the yarn packages and using such determination to position the package into a particular tray.

14. A creel comprising:

(a) a plurality of trays, each tray comprising sides and a base portion and adapted to hold a plurality of yarn packages;

(b) a frame comprising:

(i) a first open end;

(ii) a second open end opposite the first open end; and (iii) at least one shelf positioned between the first open end and the second open end, the at least one shelf configured to receive the plurality of trays so that the plurality of trays are configured to be removable from the frame; and (c) a header on the frame and separate from the plurality of trays, the header configured to simultaneously align yarns from the yarn packages of multiple trays of the plurality of trays for use by the yarn-using machine.

15. The creel of claim 14, wherein each of the plurality of trays further comprises a plurality of supports that are each configured to support one of the plurality of yarn packages.

* * * * *